US011001491B1

(12) United States Patent
Moskowitz et al.

(10) Patent No.: US 11,001,491 B1
(45) Date of Patent: May 11, 2021

(54) SELF CLOSING SPOUT

(71) Applicant: Missry Associates Inc., Edison, NJ (US)

(72) Inventors: Morris Moskowitz, Edison, NJ (US); Mok Chun Po, Aberdeen (HK)

(73) Assignee: MISSRY ASSOCIATES INC., Edison, NJ (US)

( * ) Notice: Subject to any disclaimer, the term of this patent is extended or adjusted under 35 U.S.C. 154(b) by 0 days.

(21) Appl. No.: 16/791,899

(22) Filed: Feb. 14, 2020

(51) Int. Cl.
*B67D 7/00* (2010.01)
*B67D 7/44* (2010.01)

(52) U.S. Cl.
CPC ..... *B67D 7/005* (2013.01); *B67D 7/44* (2013.01)

(58) Field of Classification Search
CPC . B67D 7/005; B67D 7/44; B67D 7/54; B65D 25/40; B65D 47/20; B65D 47/26; B65D 47/32; B65D 47/061
USPC ..... 222/481, 563
See application file for complete search history.

(56) References Cited

U.S. PATENT DOCUMENTS 4,640,446 A 2/1987 Walker
4,982,881 A * 1/1991 Amrein ..... B67D 7/0288 141/335
5,228,487 A 7/1993 Thiermann
5,249,611 A 10/1993 Law
5,628,352 A 5/1997 Gracyalny
5,762,117 A * 6/1998 Law ..... B65D 25/48 141/198
5,988,458 A 11/1999 Messner
6,155,464 A * 12/2000 Vachon ..... B67D 7/005 141/291
6,227,419 B1 * 5/2001 Raboin ..... B67D 7/005 222/484
6,435,380 B1 * 8/2002 Raboin ..... B67D 7/005 141/292
6,619,341 B2 9/2003 Cushing
6,863,098 B2 3/2005 Chrisco
6,871,680 B2 3/2005 Trippi, Jr.
7,128,108 B2 10/2006 Nielson
(Continued)

FOREIGN PATENT DOCUMENTS

WO 96/33102 A1 10/1996

OTHER PUBLICATIONS

"Scepter Replacement Eco Spout—Model# 05459," Northern® Tool + Equipment, northerntool.com, Item# 26682, accessed: Oct. 2015. http://www.northerntool.com/shop/tools/product_200513239_200513239 Discloses a polyethylene spout featuring an easy spring-loaded auto shutoff.

*Primary Examiner* — Benjamin R Shaw
(74) *Attorney, Agent, or Firm* — Hedman & Costigan, P.C.; James V. Costigan; Kathleen A. Costigan

(57) ABSTRACT

A self-closing spout having a cylindrical housing (10) with a delivery spout where the cylindrical housing is positioned around a cylindrical body (6) having a primary latching system and a secondary latching system for controlling the opening and closing of said self-closing spout when said self-closing spout is attached to a container. A circular sleeve (4) is positioned around the cylindrical body (6) for operating a valve operating system (14). The primary latching system has a latch (9) and an actuator (11) for opening the latch (9) and the secondary latching system has two stepped tabs (8) that engage a lip (10A) on the housing 10 to prevent fluid in a container to which the spout is attached from leaking.

6 Claims, 8 Drawing Sheets

(56) References Cited

U.S. PATENT DOCUMENTS

| | | | | |
|---|---|---|---|---|
| 7,621,304 | B2 | 11/2009 | Nielson | |
| 8,038,035 | B2 | 10/2011 | Forbis | |
| 8,201,595 | B2 | 6/2012 | Trippi, Jr. | |
| 8,403,185 | B2 | 3/2013 | Vachon | |
| 8,561,858 | B2 | 10/2013 | Vachon | |
| 8,800,826 | B2 * | 8/2014 | Forbis | B67D 7/005 222/484 |
| 8,950,637 | B2 | 2/2015 | Wilkins | |
| 2003/0234061 | A1 * | 12/2003 | Trippi, Jr. | B67D 7/005 141/285 |
| 2004/0025968 | A1 * | 2/2004 | Allen | B67D 7/005 141/351 |
| 2005/0092783 | A1 * | 5/2005 | Nielsen | B67D 7/005 222/505 |
| 2007/0215242 | A1 * | 9/2007 | Bonner | B67D 7/42 141/198 |
| 2008/0035240 | A1 * | 2/2008 | Nielsen | B67D 7/005 141/351 |
| 2010/0308085 | A1 * | 12/2010 | Vachon | B67D 7/005 222/484 |
| 2011/0198372 | A1 * | 8/2011 | White | B67D 7/005 222/482 |
| 2012/0118431 | A1 | 5/2012 | Dickie | |
| 2014/0097210 | A1 * | 4/2014 | Wright | B65D 47/243 222/505 |
| 2014/0103078 | A1 | 4/2014 | Wright | |
| 2019/0093823 | A1 * | 3/2019 | Scott | B67D 7/78 |
| 2019/0144172 | A1 * | 5/2019 | Vachon | B65D 25/48 222/481 |

* cited by examiner

SELF CLOSING SPOUT

FIELD OF THE INVENTION

This invention relates generally to a spout for a fuel container.

BACKGROUND OF THE INVENTION

U.S. Pat. No. 6,227,419 B1 discloses a self-closing spout for use as a pour spout for a container. The spout comprises a base with a movable sleeve that is movable along the vertical axis of the base so that when the sleeve is moved, a valve that is disposed within the base is opened. The several embodiments of the spout are provided with a spring tensioned closure mechanism that keeps the valve closed so that liquid in a container equipped with the spout will not be delivered unless the tension of the spring tensioned closure is overcome by a force that is applied downwardly from the delivery end of the self-closing spout. Under normal conditions, force will only be applied to the self-closing spout when the contents of the container are being transferred and the spring tensioned closure will prevent any liquid in the container from being inadvertently discharged.

However, it is foreseeable that a container provided with a spring tensioned self-closing spout, may be contacted with a force that will cause the spring tensioned self-closing spout to open and allow liquid in the container to be discharged. The risk of this happening is greatest when the spout is being transported in a motor vehicle.

SUMMARY OF THE INVENTION

The self-closing spout 2 for a liquid container has automatic fastening means that secure the spout from moving and opening the valve unless the fastening means are manually released. In addition to securing the spout from moving and opening the valve, the automatic fastening means will close and lock the container as soon as the opening force is released. The fastening means comprise multiple stepped tabs that engage the moveable sleeve of a self-closing spout and prevent the sleeve from moving and opening the valve.

The self-closing spout 2 preferably comprises (a) a cylindrical housing 10 having a delivery spout 1, as best seen in FIG. 7 on one end of the cylindrical housing 10 that is disposed around a cylindrical body 6 having a primary latching system and a secondary latching system for controlling the opening and closing of said self-closing spout when said self-closing spout is attached to a container by a nut 24. The nut 24 is positioned at an end of said self-closing spout opposite the end of said self-closing spout having said delivery spout 1 and a sleeve 4 is disposed on the cylindrical body 6 with sleeve 4 adapted to move back and forth on a longitudinal axis of the cylindrical body 6 to operate the valve operating system 14. The primary latching system comprises a latch 9 and an actuator 11 for opening the latch 9 and the secondary latching system comprises two stepped tabs 8 that engage a lip 10A on said housing 10.

The valve stem system is positioned in the housing 10 and comprises a rod 32, a valve end 18 on an end of rod 32 with a spring 40 positioned around rod 32. A hollow air tube 38 is also included in the valve stem system the spring 40 is adapted to maintain the valve end 18 in a closed position when no force is applied on said spring.

The hollow air tube 38 is adapted to allow ambient air to communicate with a container to which said self-closing spout is attached only when the valve end 18 is open. A movable sleeve 4 is preferably positioned around the body 6 so that the movable sleeve may be moved along the body 6 away from the nut 24 to release the secondary latching system and contact lip 10A of the housing 10 while also pressing on the actuator 11 to release said primary latching system.

After the moveable sleeve 4 is moved to be in contact with the lip 10A of the housing 10, the housing 10 and the sleeve are simultaneously moved along said body 6 towards the nut 24 so that that the housing 10 causes spring 40 to be compressed and valve end 18 to be opened. The simultaneous movement of the housing 10 and sleeve 4 towards the nut 24 is carried out while the housing 10 and nut 24 are in contact with one another.

An O-ring 20 is preferably provided in a groove 20A on valve end 18 to seal said valve system so that no liquid or vapors will be ejected from a container to which the self-closing spout is attached.

DETAILED DESCRIPTION OF THE INVENTION

Figure 1:
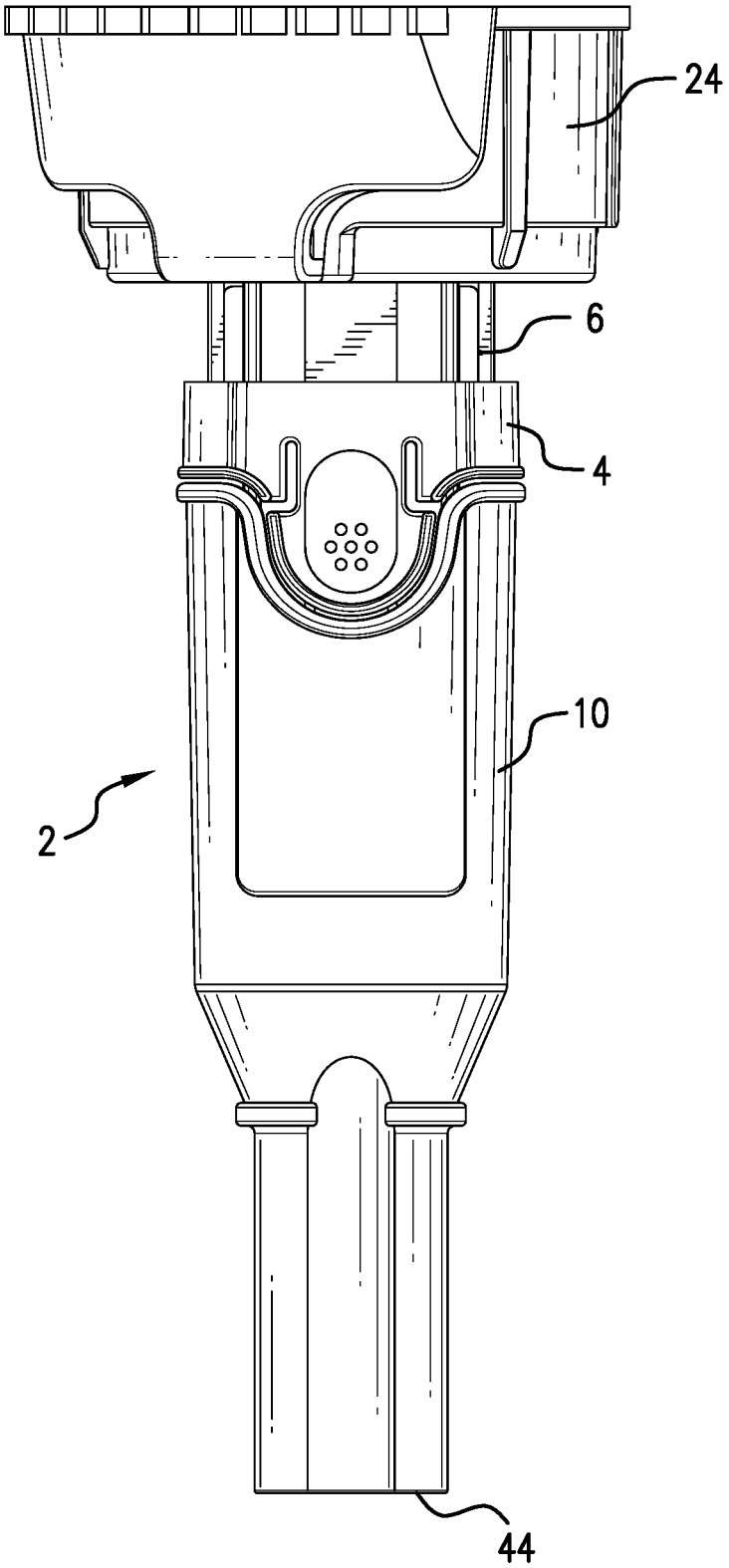
FIG. 1 is a side elevational view of the self-closing spout of the invention with the sleeve engaged in the unlocked position.

A preferred embodiment of the invention is disclosed in FIG. 1 which shows the assembled self-closing spout 2 having a body 6 and a housing 10 with a circular sleeve 4 in a closed position on the body 6 of the self-closing spout. The parts of the self-closing spout are preferably molded from a suitable thermoplastic that will resist the solvent action of motor fuels. The sleeve 4 is movable on the body 6 from a closed position show in FIG. 3 away from the nut 24 towards the end of the housing having a spout opening 44 as shown in FIG. 3 to a lock disengaging position as shown in FIG. 1 where sleeve 4 is in close proximity to lip 10A of housing 10.

Figure 3:
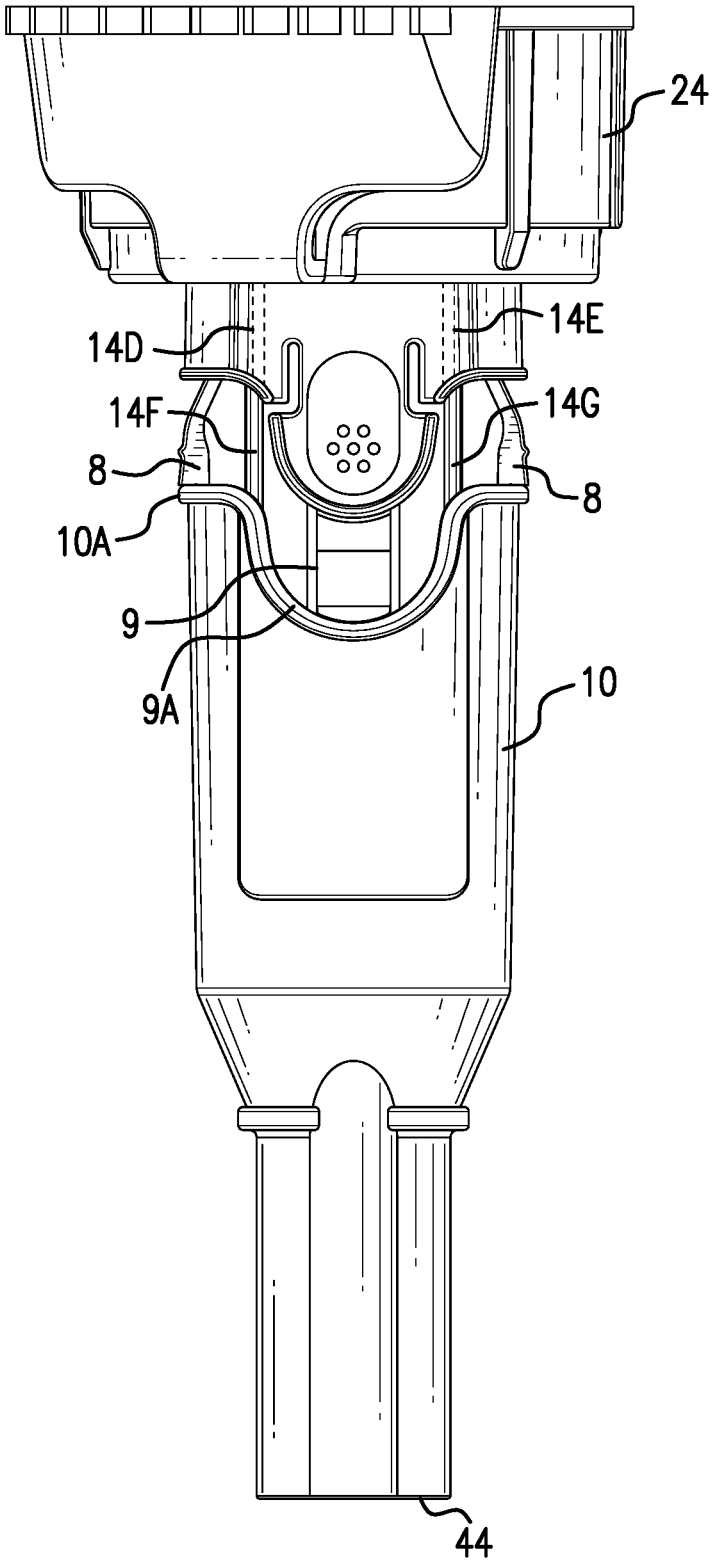
FIG. 3 is a side elevational view with the vertical cross-section of the self-closing spout of the invention with the sleeve in the locked position.

In FIG. 3, the sleeve 4 is shown in a position that is spaced apart from the lip 10A of housing 10. When sleeve 4 is spaced away from housing 10 as shown in FIG. 3, the housing 10 is in a locked position of a primary latching system and a secondary locking system. When housing 10 is in a locked position, the valve stem system 14 is prevented from opening which keeps a container that is attached to the spout from leaking liquids or vapors.

Figure 5:
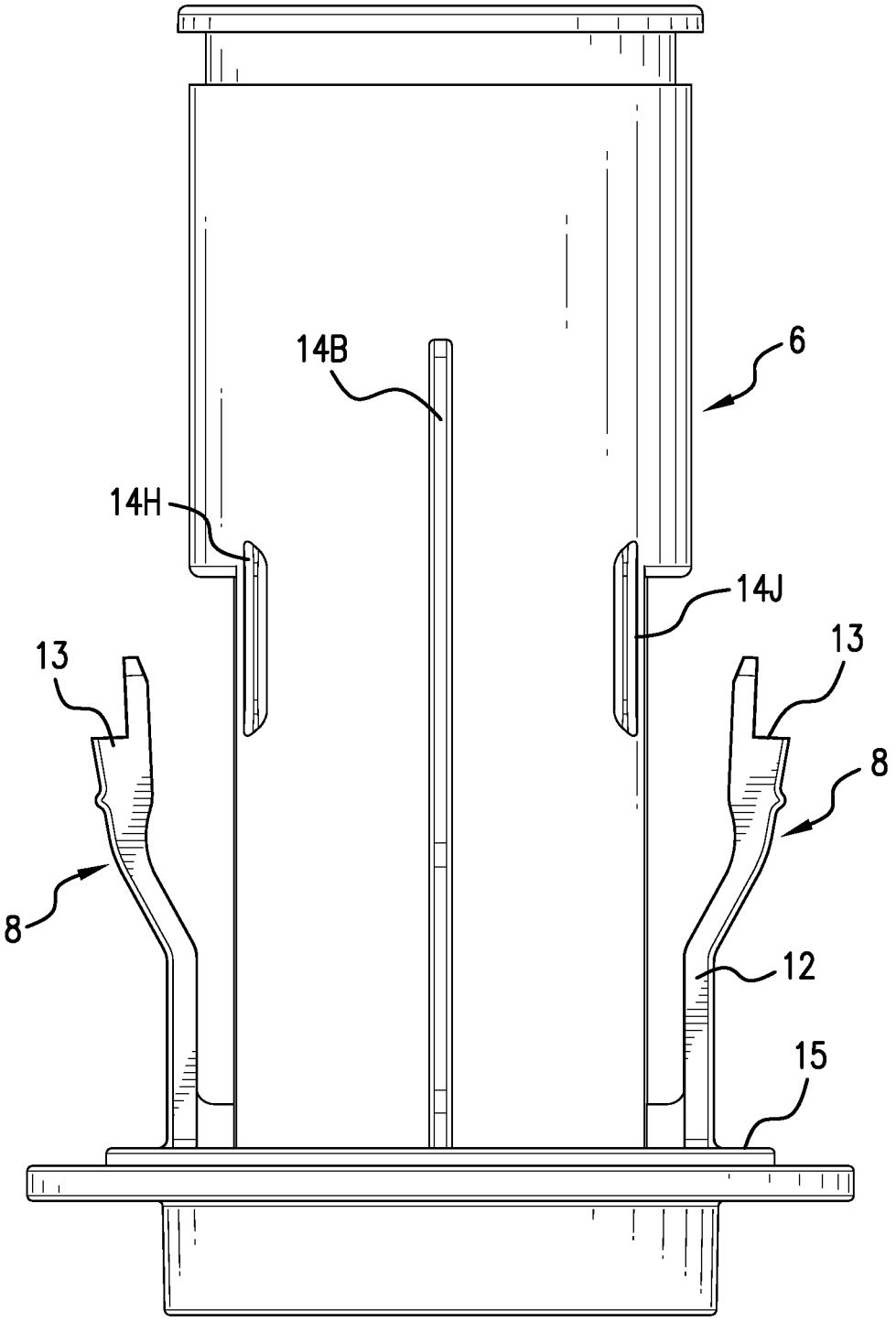
FIG. 5 is a side view of the body of the self-closing spout.

The primary latching system comprises a latch 9 on sleeve 2 that engages the body 6 and a disengaging actuator 11 which is also positioned on the sleeve 4. The secondary latching system comprises two stepped tabs 8 on the body that engage a lip 10A on the housing 10 as shown in FIG. 3. The primary latching system comprises a latch 7 on sleeve 4 that is disengagable from the body 6 using actuator 11. The secondary latching system preferably comprises two stepped tabs 8 attached to the body 6 by flexible shafts 12 as stepped tabs 8 that are shown FIG. 5. The side view of stepped tabs 8 in FIG. 5 shows a step 13 that engages the lip 12 A of housing 10 when sleeve 4 is disengaged.

Figure 6:
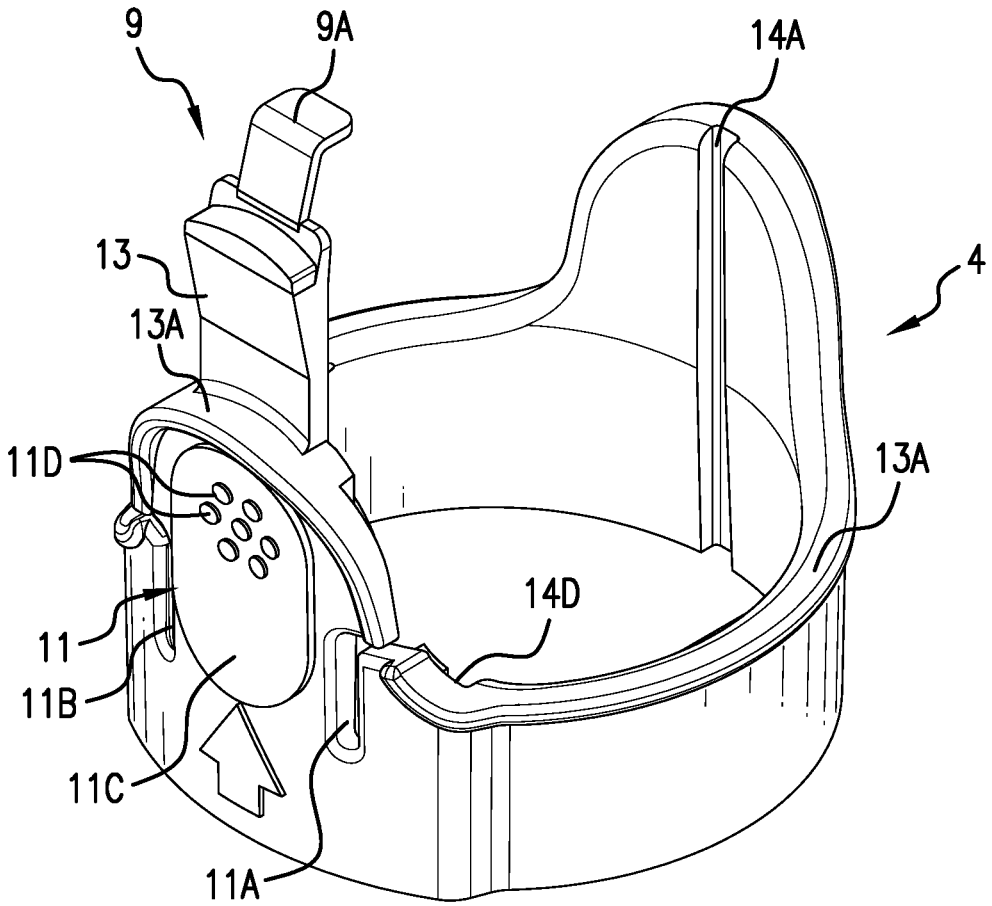
FIG. 6 is a perspective view of the sleeve of the self-closing spout which shows the primary locking system which comprises a latch.

As best shown in FIG. 6, the actuator 11 is preferably formed as a part of a resilient structure 13 that has having latch 9 affixed to the end of resilient structure 13. Latch 9 has a projection 9A that is adapted to movably engage lip 10A of housing 10 at the same time that stepped tabs 8 engage lip 10A to prevent movement of the housing 10 towards the end of the spout, where nut 24 is positioned, which would open valve end 18. Actuator 11 is formed as a part of the wall of sleeve 4 as shown in FIG. 6 by forming slots 11A and 11B into the sides of sleeve 4 so that the actuator 11 is formed as a flexible tab as best shown in FIG. 6. The actuator 11 preferably has a finger directing pad 11C with finger directing projections 11D.

FIG. 3 shows the actuator 11 as being formed on sleeve 4 outwardly on a semi-circular tab that is sized to fit within a complimentary cut-out on the housing 10. The portion of sleeve 4, including the portion of the actuator 11 that contacts the housing 10 is preferably provided with a lip 13A. A slot 14A is provided on sleeve 4 on an interior wall which is sized to engage the complimentary rib 14B on the exterior of body 6 which is shown on FIG. 5 which also shows ribs 14H and 14J which are positioned on the exterior of body 6 to act as spacers between the housing 10 and the body 6. FIG. 3 shows ribs 14F and 14G which are on body 6 where they are positioned to engage interior slots 14D and 14E on sleeve 4 which are shown in phantom by dotted lines on FIG. 3.

The secondary latching system which preferably comprises stepped tabs 8 at the end of flexible shafts 12, has the stepped tabs 8 arranged on the body 6 so that the stepped tabs 8 are positioned about 180° apart on a circular base element 15 of the body 6. The circular base 15 preferably comprises two concentric rings having different diameters as shown in FIG. 5. The stepped tabs 8 are positioned so that an indent 13 on the stepped tabs 8 is adapted to engage the lip 10A of housing 10 when sleeve 4 is disengaged. When the stepped tabs 8 engage the lip 10A of housing 10, the housing cannot be moved towards the nut 24 which would open valve end 18. The stepped tabs 8 are disengaged by sliding the sleeve 4 away from the end having nut 24 while pressing inwardly on actuator 11 to disengage the primary locking system.

Figure 2:
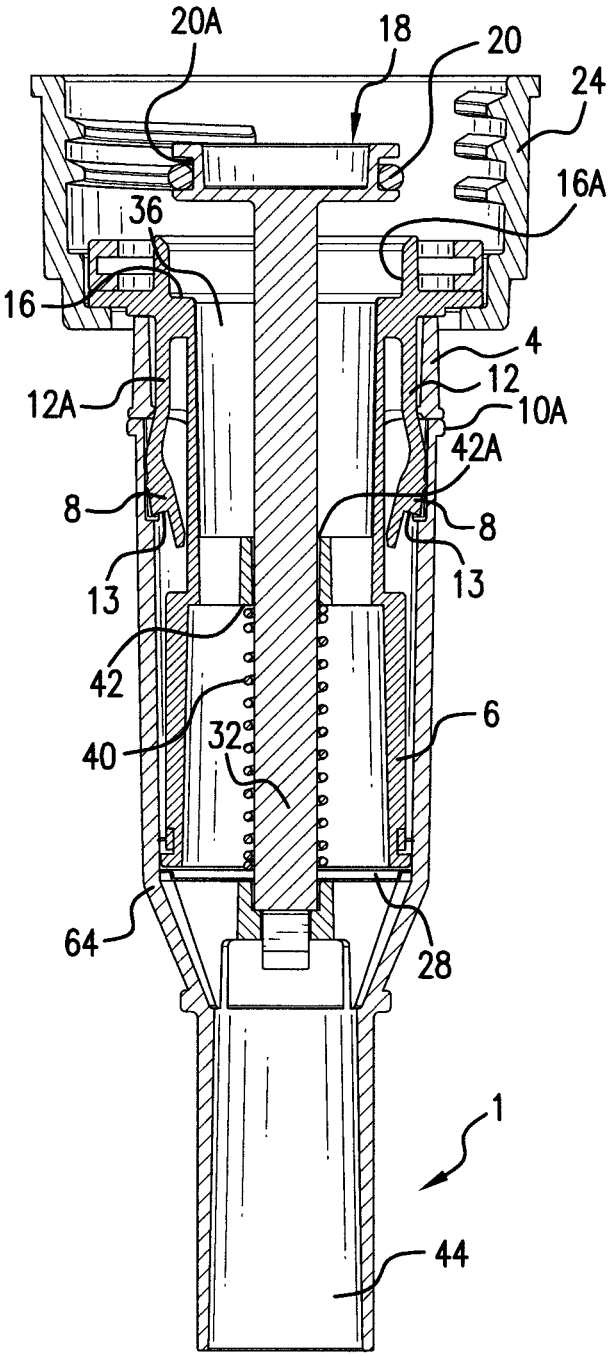
FIG. 2 is a vertical cross-section of the self-closing spout of the invention with the valve in the open position.

FIG. 2 is a cross section of the assembled spout showing the housing 10 positioned over the body 6 and sleeve 4 in the open position to form opening 36 at valve end 18. As shown in FIG. 2, the valve stem system 14 has a valve end 18 with an O-ring 20 positioned in a groove 20A. The O-ring 20 is sized to provide a seal when the force applied against spring 40 is removed to allow O-ring 20 to contact the side 16A of valve seat 16.

In operation, it is contemplated that manually applied pressure will be used to move the sleeve 4 over the stepped tabs 8 to force stepped tabs 8 back from the lip 10A of housing 10 while depressing actuator 11 of the primary locking system and simultaneously moving the sleeve 4 and housing 10 over the body 4 towards the nut 24 to depress spring 40 to cause the valve end 18 to open and form opening 36. The opening 36 will communicate with the interior of the spout that is formed by the body 6 and housing 10 to allow any fluid in the container to be delivered from the self-closing spout 2 at opening 44.

Nut 24 is freely rotatable around the flanged end 24A of the body as shown in FIG. 2 unless it is affixed to a container. This allows for attaching and detaching a self-closing spout to a container. A serrated locking device 24A is provided on the nut to prevent rotation of the nut 24 when the nut 24 is affixed to a container for liquids that is provided with a complimentary track that engages the serrated locking device 24A.

FIG. 1 shows the sleeve 4 engaged in a position where the stepped tabs 8 are disengaged from lip 10A before the sleeve 4 and housing 10 are simultaneously moved towards the nut 24 to cause the valve end 18 to open as shown in FIG. 2. FIG. 3 shows the sleeve disengaged from stepped tabs 8 and the stepped tabs engaged in a latching position at the lip 10A of housing 10.

Figure 4:
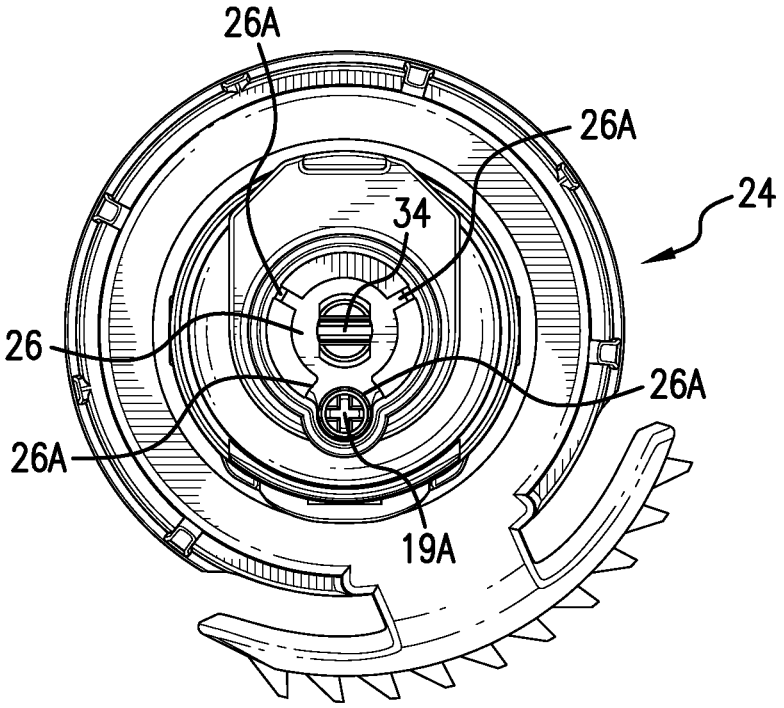
FIG. 4 is a top view of the housing of the self-closing spout which shows an end of the valve sealing system.
Figure 8:
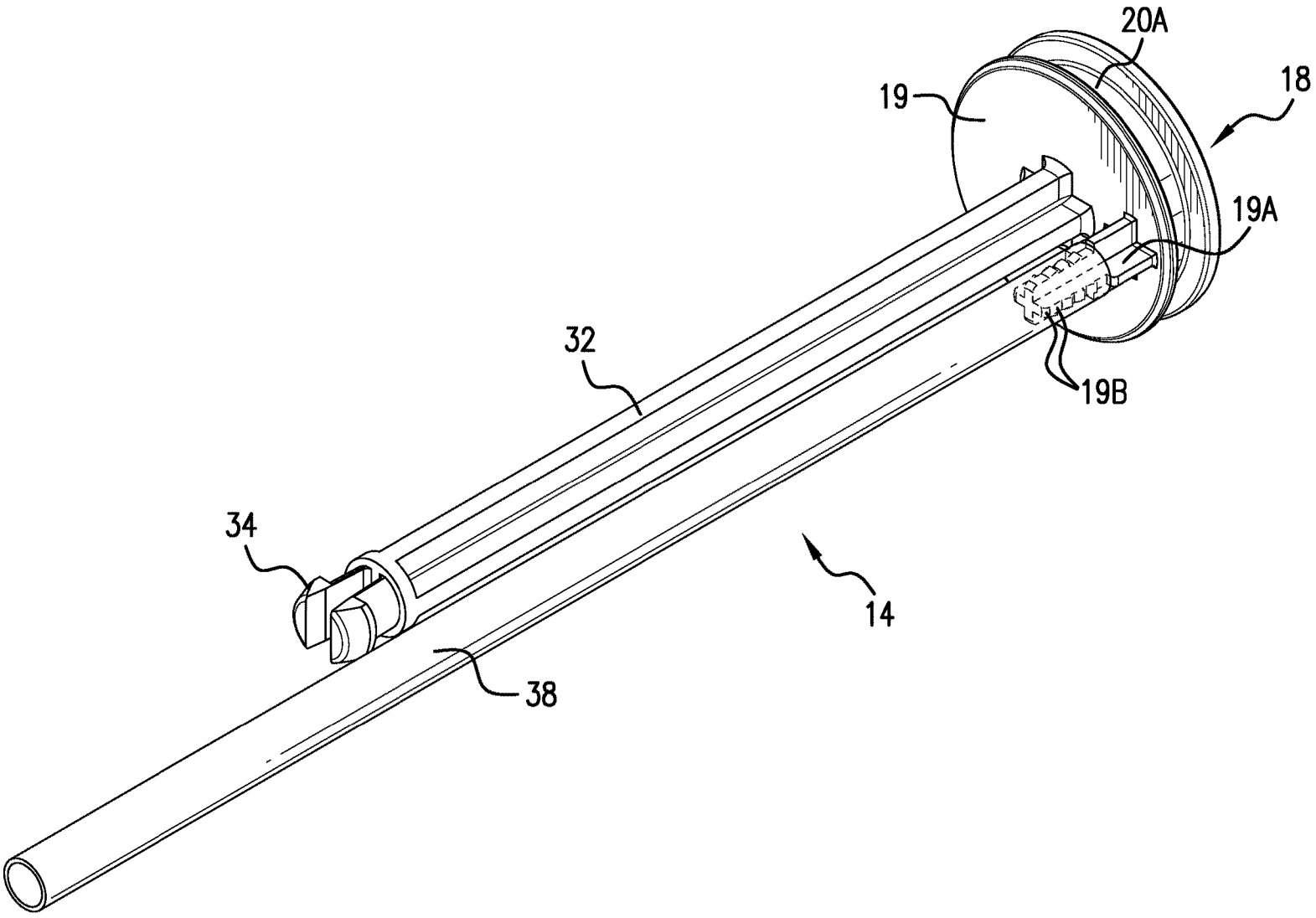
FIG. 8 is a perspective view of the valve stem and sealing end of the self-closing valve.

FIG. 2 shows an internal support 28 having four legs 26A, as best shown in FIG. 4, that are attached to wall 6A of housing 10. The internal support 28 has an opening to accommodate the hollow air tube 38 and is also adapted to receive a snap-in fitting 34 on the end of a rod 32 of the valve system 14 that is shown in FIG. 8. The rod 32 is preferably made of a plastic that is sufficiently flexible so that the snap-in fitting 34 may to fixed to the internal support wall 28 at an opening 28A at the opposite end of rod 32 to which valve end 18 is attached.

When the rod 32 is fixed to internal support wall 28 of housing 10 and the body 6 and sleeve 4 are engaged as shown in FIG. 1, the housing 10, body 6 and sleeve 4 may be simultaneously moved toward the nut 24 to open valve end 18 to provide an opening for delivery of liquid through channel 36. A spring stop element 42 is provided in body 6 to restrain spring 40 when spring 40 is compressed along rod 32 to make the valve stem system self-closing and self-locking when the manual force used to move the housing 10 and sleeve 4 towards the nut is released. Spring stop element 42 is preferably made as a four legged element having the shape of internal support element 28 and is attached to the body 6. The spring stop element 42 is positioned in line with the internal support element 28 so that the hollow air tube 38 may pass through the internal support element 28 in the housing 10 and the opening 42A is sized so that it acts as a stop for spring 40 and allows valve stem 32 to move through opening 42A when the housing, body and sleeve are moved towards nut 24.

The spring 40 is compressed when the housing 10, body 6 and the sleeve 4 are engaged and moved toward the nut 24 to release the primary and secondary release systems.

When the engaged housing 10, body and sleeve 4 are moved towards the nut 24, the valve end 18 of the valve system 14 opens and channel 36 is formed. As best seen in FIG. 8, the valve stem system 14 also has a hollow air tube 38 that communicates with an opening 44 on the end of the housing 10 that is opposite the end of the housing having lip 10A that engages sleeve 4. The hollow air tube is provided in order of avoid any vacuum effect that will interfere with the smooth delivery of fluid from a container that is attached to the self-closing and self-locking spout through opening 36.

The hollow air tube 38 will only be in communication with the interior of a container when the valve end 18 is moved to an open position as shown in FIG. 2. The sealing of the hollow air tube 38 in the closed position will prevent any fluid or vapor from being ejected from a container self-closing spout is attached if the container if the container is accidently or intentionally moved from an upright position. The attachment of the hollow air tube 38 is made to a surface 19 of the valve end 18 which is adjacent to the groove 20A for the O-ring 20. The fitting for the attachment of the hollow air tube 38 is preferably a fixed cross-shaped post 19A on the surface 19 of the of the valve end 18 as shown in FIG. 8. The cross shaped post 19A is only fixed to surface 19 of valve end 18 in such a manner that there is no communication between the surface 19A and any part of an interior of the valve end 18.

The cross shaped post 19A has a series of notches 19B, shown in phantom in FIG. 8, which are sized so that they will firmly engage the interior of an end of hollow air tube 38 so that the hollow air tube 38 will be fixed to surface 19 of the valve end 18 while providing one or more air channels that will communicate with the interior of a container that is attached to the self-closing spout only when the valve stem system is moved to provide an opening 36. A stop 19C is provide on the post 19A so that hollow air tube 38 cannot be pressed down on surface 19 to prevent air from passing through hollow air tube 38.

In the top view of the self-closing spout that is shown in FIG. 4, the top of hollow air tube 38 is seen as well as the cross-shaped post 19A.

Figure 7:
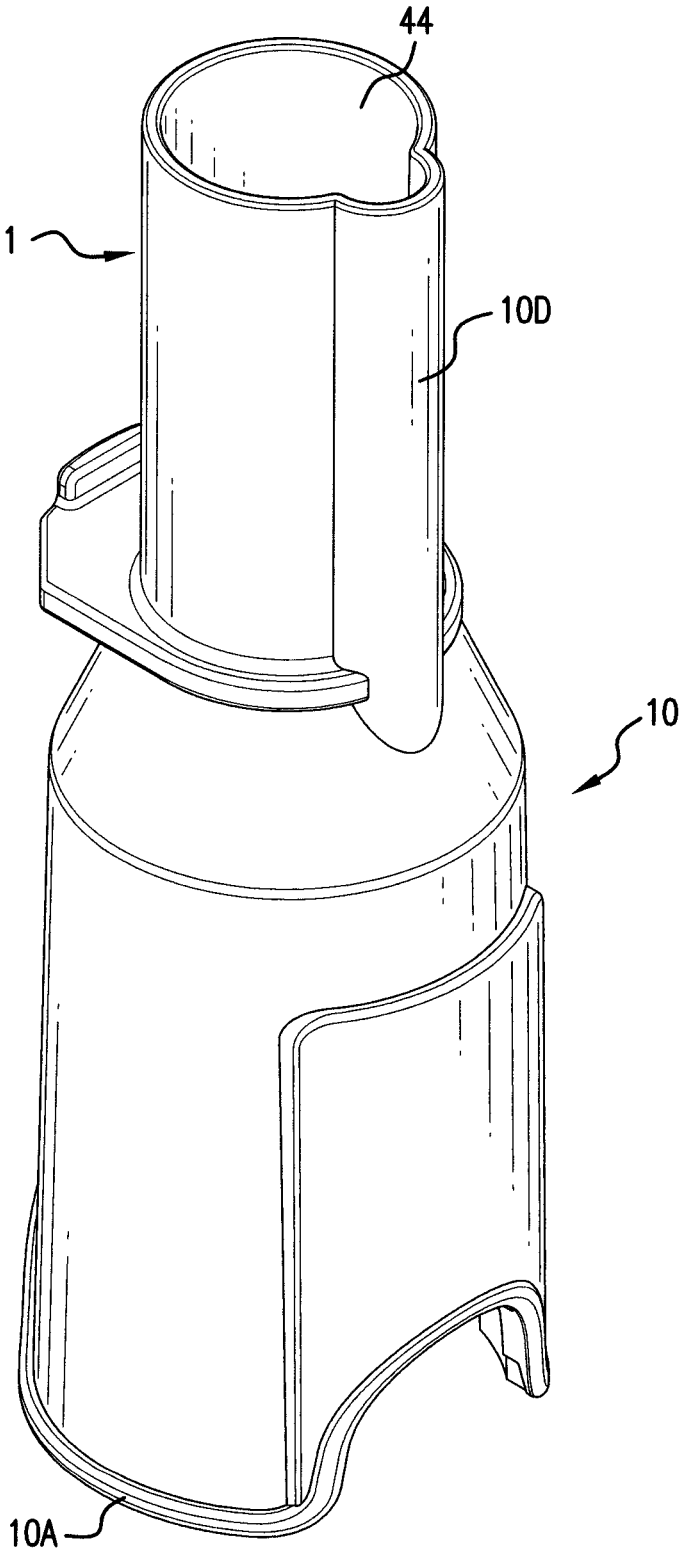
FIG. 7 is a perspective view of the housing of the self-closing spout.

FIG. 7 is a perspective view of housing 10. The space for accommodating hollow air tube 38 is shown as a semicircular extension 10D on the housing.

It is contemplated that the typical container will be a blow molded plastic container having a threaded opening that is compatible with nut 24 and has a 1-5 gallon capacity for liquids such as flammable motor fuels. These well know containers are commercially available and are depicted in U.S. Pat. No. 6,227,419 B1 which is incorporated by reference.

The invention claimed is:

1. A self-closing spout for a container which comprises;

(a) a cylindrical housing (10) having a delivery spout (1) and an opening (44) on one end of said cylindrical housing (10), said cylindrical housing (10) being disposed around a cylindrical body (6) that is provided with a primary latching system and a secondary latching system for controlling the opening and closing of said self-closing spout when said self-closing spout is attached to a container by a nut (24) positioned at an end of said self-closing spout opposite the end of said self-closing spout having said delivery spout (1);

(b) a sleeve (4) disposed on said cylindrical body (6), said sleeve (4) being adapted to move back and forth on a longitudinal axis of said cylindrical body (6) to operate a valve operating system (14);

where said primary latching system comprises a latch (9) and an actuator (11) for opening said latch (9) and where said secondary latching system comprises two stepped tabs (8) that engage a lip (10A) on said housing (10).

2. A self-closing spout as defined in claim 1 wherein a valve stem system is provided in said cylindrical housing (10) which comprises a rod (32), a valve end (18) on an end of said rod (32) and a spring (40) positioned around said rod (32) said spring (40) being adapted to maintain said valve end (18) in a closed position when no force is applied on said spring.

3. A self-closing spout as defined in claim 1 where said valve stem system (14) includes a hollow air tube (38) which is adapted to allow ambient air to communicate with a container to which said self-closing spout is attached only when said valve end (18) is open.

4. A self-closing spout as defined in claim 1 wherein a movable sleeve (4) is positioned around said body (6) so that said movable sleeve (4) may be moved on said body (6) towards said cylindrical housing (10) to release said secondary latching system and contact said lip (10A) of said cylindrical housing (10) when pressure is placed on said actuator (11) to release said primary latching system.

5. A self-closing spout as defined in claim 4 wherein after said moveable sleeve (4) is moved to contact said lip (10A) of said cylindrical housing (10), said cylindrical housing (10) and said sleeve are simultaneously moved along said body (6) towards said nut (24) so that that said cylindrical housing (10) causes spring (40) to be compressed and valve end (18) to be opened.

6. A self-closing spout as defined in claim 5 where an O-ring (20) is provided in a groove (20A) to seal said valve system so that no liquid or vapors will be ejected from a container to which the self-closing spout is attached.

* * * * *